United States Patent [19]

Ramcke

[11] Patent Number: 4,484,501

[45] Date of Patent: Nov. 27, 1984

[54] APPARATUS FOR CUTTING AND TRIMMING PAPER SHEETS OR THE LIKE

[75] Inventor: Bernd Ramcke, Hamburg, Fed. Rep. of Germany

[73] Assignee: E.C.H. Will (GmbH & Co.), Hamburg, Fed. Rep. of Germany

[21] Appl. No.: 418,091

[22] Filed: Sep. 14, 1982

[30] Foreign Application Priority Data

Jan. 28, 1982 [DE] Fed. Rep. of Germany ..... 3202753

[51] Int. Cl.[3] ..... B26D 5/20

[52] U.S. Cl. ..... 83/255; 83/39; 83/404; 83/404.4; 83/732; 412/2; 412/16; 83/560

[58] Field of Search ..... 83/35, 39, 42, 158, 83/251, 253, 254, 255, 404, 404.4, 408, 256, 207, 421, 132, 925 A, 401, 701, 560; 412/2, 16; 271/267, 269, 271; 198/485, 456, 748; 144/245 D, 245 E; 493/82

[56] References Cited

U.S. PATENT DOCUMENTS

| | | | |
|---|---|---|---|
| 1,076,726 | 10/1913 | Welch | 83/925 A X |
| 2,618,207 | 11/1952 | Hery et al. | 493/82 |
| 3,207,017 | 9/1965 | McCain | 83/925 A |
| 3,238,824 | 3/1966 | Jallo | 83/401 X |
| 3,250,162 | 5/1966 | Bunting | 83/925 A |
| 3,540,340 | 11/1970 | Koskela | 83/560 X |
| 3,811,350 | 5/1974 | Marciniak | 83/925 A |

FOREIGN PATENT DOCUMENTS

| | | | |
|---|---|---|---|
| 834667 | 5/1960 | United Kingdom | 83/39 |

*Primary Examiner*—Paul A. Bell
*Assistant Examiner*—Taylor J. Ross
*Attorney, Agent, or Firm*—Peter K. Kontler

[57] ABSTRACT

Apparatus for trimming the lateral marginal portions of successive stacks of sheets of multiple unit width and for subdividing the trimmed stacks into stacks of unit width has an advancing unit which moves the stacks stepwise in a direction at right angles to their width, a trimming station where the marginal portions of successive stacks are trimmed, and two or more severing stations which are disposed one after the other, as considered in the direction of advancement of the stacks, and at each of which the width of the stacks is reduced by one unit width as a result of separation of discrete stacks of unit width therefrom. The stacks at the severing stations are moved sideways by the width of a stack of unit width prior to a separating step. The mechanisms at the severing stations employ knives which are aligned with one another, as considered in the direction of advancement of stacks, and are accessible at the outer sides of the respective severing stations.

19 Claims, 4 Drawing Figures

APPARATUS FOR CUTTING AND TRIMMING PAPER SHEETS OR THE LIKE

BACKGROUND OF THE INVENTION

The present invention relates to apparatus for manipulating individual or stacked sheets of paper, foil, cardboard or the like. More particularly, the invention relates to improvements in apparatus for subdividing relatively large sheets of paper or the like into smaller sheets or leaves which can be used for the making of various types of stationery products, such as pads, books and the like. Still more particularly, the invention relates to improvements in apparatus of the type wherein sheets are severed by instrumentalities extending in the direction of transport of sheets toward and beyond the severing location or locations.

Presently known severing apparatus which are utilized to subdivide individual or stacked sheets into sets of two or more smaller sheets or leaves comprise a battery of severing or subdividing knives which are disposed at a severing station and are actuated at the same time to subdivide a sheet or a stack of sheets at such station into several (e.g., four) smaller sheets or leaves. The apparatus can further include trimming knives which are designed to remove the surplus from two lateral marginal portions of a sheet or stack of sheets at the severing station. Such apparatus operate quite satisfactorily as long as the sheets are relatively thin and/or as long as the height of stacks of superimposed sheets is rather low. However, once the height or thickness of a stack of sheets at the severing station exceeds a certain value, the apparatus of the above outlined character are incapable of doing an acceptable job, especially as concerns the quality of cuts and the accuracy of the trimming or surplus-removing operation. This is due to the fact that the leaves, which are obtained in response to simultaneous severing of a sheet or a stack of sheets at the single severing station, must yield sideways in order to account for the thicknesses of severing knives. However, there is no room to yield because each leaf is confined between two neighboring knives or between a severing knife and the adjacent trimming knife. Consequently, the leaves are compelled to bulge in the course of the severing operation which causes the formation of inferior cuts, namely, the planes of lateral edges of the freshly formed leaves are not normal to the planes of individual leaves. The quality of the cutting operation is also unsatisfactory in other respects, for example, because the lateral edges are not entirely straight due to progressive bulging of leaves in the course of simultaneous movement of two trimming knives and one or more severing or subdividing knives against and through the sheet or stack of sheets at the single severing station. Moreover, the removal of freshly formed leaves also presents problems, especially if the outline of the space which is available is such that there might be sufficient room, as considered in the direction of delivery of sheets to the single severing station, but not at right angles to such direction.

OBJECTS AND SUMMARY OF THE INVENTION

An object of the invention is to provide a novel and improved apparatus which is capable of converting a succession of relatively large sheets or stacks of sheets into smaller sheets or leaves whose dimensions invariably match the required dimensions.

Another object of the invention is to provide an apparatus which is capable of reliably treating relatively large, relatively small, relatively thick or relatively thin sheets as well as individual sheets or tall or thin stacks of two or more superimposed sheets each.

A further object of the invention is to provide a combined sheet trimming and subdividing apparatus which can be used with advantage in production lines for the making of steno pads, exercise books and analogous stationery products.

An additional object of the invention is to provide a novel and improved method of transporting, trimming and subdividing single or stacked sheets consisting of paper or the like.

Another object of the invention is to provide an apparatus whose operation is sufficiently predictable and reliable to obviate the need for any secondary treatment of subdivided sheets for the purpose of correcting the quality of trimmed or other edges.

Still another object of the invention is to provide the apparatus with novel and improved means for moving the sheets and leaves prior and subsequent to severing.

An additional object of the invention is to provide a novel distribution of severing mechanisms in an apparatus of the above outlined character.

Another object of the invention is to provide an apparatus which is constructed and assembled in such a way that the material being severed has room to yield during severing in order to account for the thicknesses of severing tools.

The invention resides in the provision of an apparatus for subdividing sheets of multiple unit width, particularly for subdividing paper sheets of multiple unit width, into leaves of unit width. The apparatus comprises advancing means which is operable to move a succession of sheets in a predetermined direction along a predetermined path at right angles to the width of the sheets, a plurality of severing stations disposed in successive portions of the path, as considered in the aforementioned direction, severing units provided at the severing stations and each including means for separating a leaf from the sheet at the respective station during the interval of dwell of the advancing means between successive operations of such advancing means to move the sheets from the preceding to the next-following stations, as considered in the aforementioned direction, and means for transporting the sheets at the severing stations at right angles to the aforementioned direction prior to separation of leaves from such sheets, and prior to the next-following operation of the advancing means, through increments corresponding to a unit width (i.e., to the width of a leaf). The separating means preferably comprises knives which are aligned with one another, as considered in the aforementioned direction, and such knives are preferably located at the outer sides of the respective severing stations to ensure convenient accessibility of such knives.

Each separating means can comprise a stationary knife at one side of the path and a mobile knife at the other side of the path. If the path is at least substantially horizontal, the mobile knives are preferably disposed at a level above such path. The apparatus preferably further comprises common drive means for the mobile knives.

Each of the aforementioned transporting means can comprise an endless belt or another suitable flexible element and a pusher or an analogous sheet entraining element provided on and extending outwardly from the flexible element. The apparatus further preferably comprises common drive means for the flexible elements, and such drive means can comprise a shaft extending in the aforementioned direction, means for transmitting motion from the shaft to the flexible elements, and means for rocking the shaft back and forth. Such rocking means can include a first gear on the shaft, a second gear meshing with the first gear, and cam-and-follower means for rotating the second gear back and forth. The rocking means can further comprise a lever, a gear segment provided on one arm of the lever and constituting the aforementioned second gear, and a coupling member articulately connected with another arm of the lever and with the cam-and-follower means. Such drive means preferably further comprises a rotary feed screw on the lever or other suitable adjusting means for changing the distance between the pivot means for the lever and the locus of connection between the coupling member and the other arm of the lever. This enables an attendant to convert the apparatus for the separation of leaves having different widths.

The improved apparatus preferably further comprises a trimming station which is located in a further portion of the path ahead of the foremost severing station, as considered in the aforementioned direction, and means for trimming two lateral marginal portions of successive sheets at the trimming station. The trimming means preferably comprises first and second knife holders disposed at the opposite sides and flanking the further portion of the path and means (e.g., a rotary feed screw) for shifting one of the holders toward or away from the other holder to thus convert the apparatus for the trimming of wider or narrower sheets.

The apparatus can also comprise take-off conveyor means adjacent to one side of the path and serving to remove freshly formed leaves from the severing stations by moving such leaves in the aforementioned direction.

The sheet advancing means can comprise a plurality of endless conveyors disposed in parallel vertical planes and having pushers or analogous entraining means for advancing the sheets in the path from station to station. Such advancing means preferably comprises means for advancing one-half of the sheet at the last severing station (as considered in the aforementioned direction) into a further portion of the path, and the apparatus then comprises additional transporting means for removing such half sheet from the further portion of the path by moving the half sheet at right angles to the aforementioned direction.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
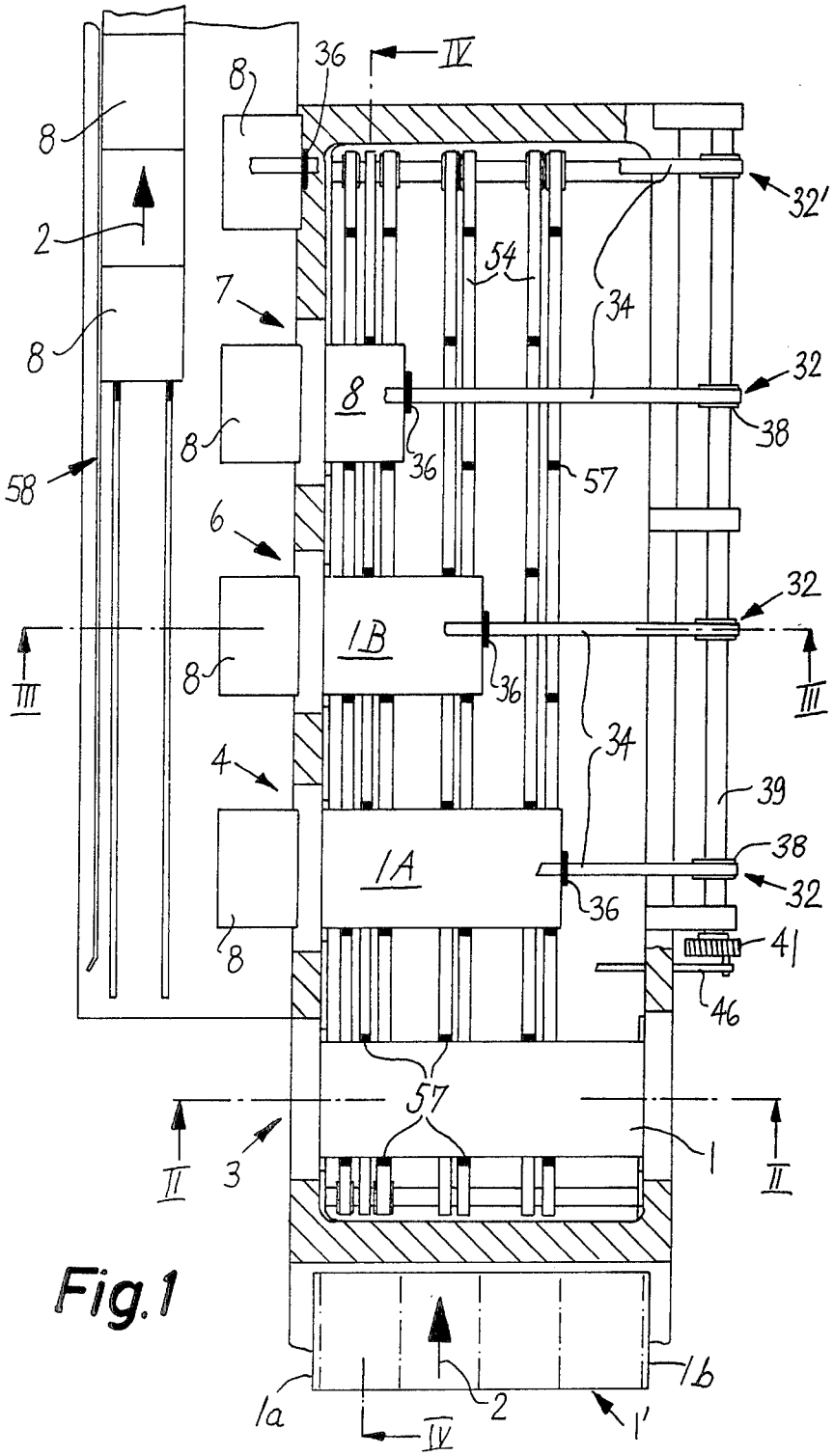
FIG. 1 is a plan view of an apparatus which embodies the invention and is designed to trim sheets of four times unit width as well as to subdivide each trimmed sheet into four smaller sheets or leaves of unit width.

Referring to FIG. 1, there is shown an apparatus which serves to subdivide relatively large sheets or layers 1 (each such sheet can constitute one of a stack of superimposed sheets) into smaller sheets or leaves 8, e.g., into leaves whose size matches that of those in a note book, steno pad, exercise book or the like. The apparatus comprises means for advancing the sheets 1 along a horizontal path in the direction of arrow 2, and several severing stations which are disposed one after the other, as considered in the direction of arrow 2. It will be noted that the sheets 1, as well as smaller fractions of such sheets (namely, full sheets minus one, two or more leaves 8) are transported in a direction at right angles to their maximum dimensions, namely, at right angles to their width.

Figure 2:
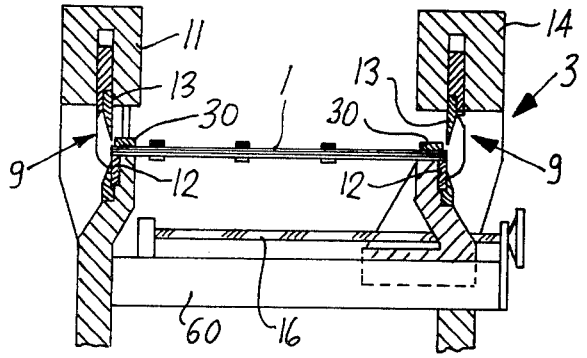
FIG. 2 is a transverse sectional view of the mechanism at the trimming station, substantially as seen in the direction of arrows from the line II—II of FIG. 1.

The first or foremost severing station 3, as considered in the direction of arrow 2, is a trimming station wherein suitable knives remove the surplus from the one and/or the other longitudinally extending marginal portion 1*a* and/or 1*b* of each freshly delivered sheet 1'. The details of the first severing or trimming station 3 are shown in FIG. 2.

Each of the sheets 1 (only one shown in FIG. 1) constitutes a leaf of four times width; therefore, the illustrated apparatus has three additional severing stations 4, 6 and 7 wherein each successive sheet 1 is converted into a sheet 1A of three times unit width plus a leaf 8 (station 4), wherein each successive sheet 1A is converted into a sheet 1B of two times unit width plus a leaf 8 (station 6) and wherein each successive sheet 1B is converted into a pair of leaves 8 (station 7). The severing station 4 is practically identical with the severing station 6 or 7; therefore, FIG. 3 merely shows the details of the severing station 4.

Figure 4:
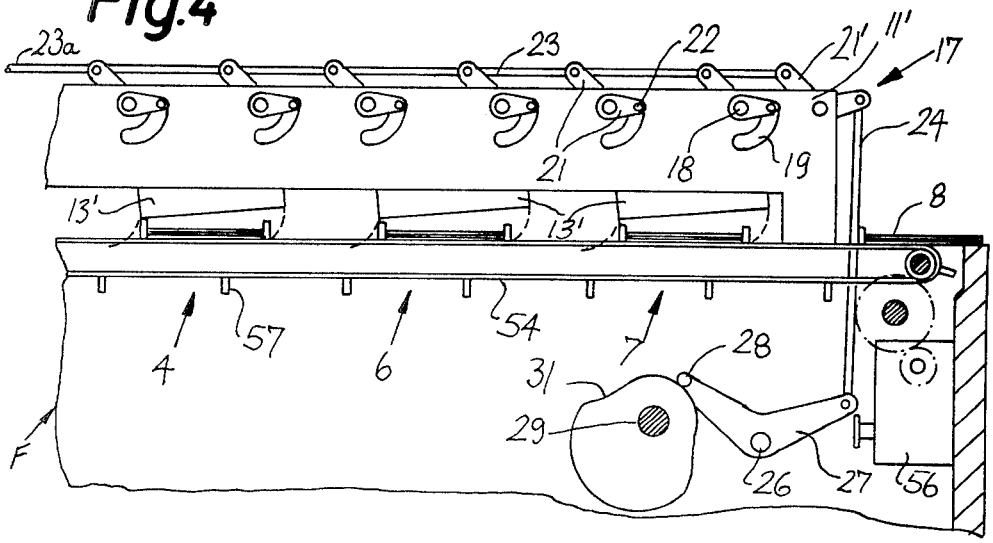
FIG. 4 is a fragmentary longitudinal vertical sectional view as seen in the direction of arrows from the line IV—IV of FIG. 1.

FIG. 4 shows the means for advancing the sheets 1, 1A, 1B and halves (leaves 8) of successive sheets 1B in the direction of arrow 2.

The mechanism at the severing or trimming station 3 comprises two substantially mirror symmetrical trimming devices 9 each of which comprises a knife holder, a fixedly mounted lower knife or blade 12 in the respective holder, and an upper knife or blade 13 which is movable up and down in the respective holder. The left-hand holder of FIG. 2 is denoted by the reference character 11, and the right-hand holder is shown at 14. The holder 14 is shiftable toward or away from the holder 11 by an adjusting device here shown as a feed screw 16 which is rotatably mounted in a frame member 60 and meshes with the holder 14. Such adjustment enables an attendant to convert the mechanism including the two trimming devices 9 for the treatment of wider or narrower sheets 1. For example, the structure at the station 3 can be converted for the trimming of sheets 1 of three times unit width (i.e., the width of each freshly introduced sheet can match that of the sheet 1A shown in FIG. 1).

The fixed knives 12 are located at a level below, and the mobile knives 13 are located at a level above the horizontal path which is defined by the advancing means. The same holds true for the knives of the mechanisms at the severing stations 4, 6 and 7. The holders 11 and 14 of the mechanism at the trimming station 3 flank that portion of the path for the sheets 1' wherein such sheets are relieved of the surplus while the advancing means is idle between successive operations during each of which the advancing means moves a trimmed sheet 1 from the station 3 to the station 4, a sheet 1A from the station 4 to the station 6, a sheet 1B from the station 6 to the station 7, and one-half of a sheet 1B beyond the station 7, as considered in the direction of arrow 2.

The mechanisms at the stations 4, 6 and 7 are designed to sever the oncoming sheets (1, 1A and 1B) only once; therefore, each such mechanism comprises a single severing device 9' having a holder 11' which is common to all three devices 9', a lower knife or blade 12' which is fixedly mounted in the holder 11', and a mobile upper knife or blade 13' which is movable up and down in the holder 11'. The severing devices 9' at the stations 4, 6 and 7 are in accurate alignment with each other, as considered in the direction of arrow 2.

The means for moving the upper knives 13' of the three severing devices 9' comprises a single driving unit 17 which is shown in FIG. 4. Such driving unit comprises three pairs of bell crank levers 21 each of which is pivotable about the axis of a shaft 18 and is guided in a discrete arcuate groove 19 of the holder 11'. The grooves 19 extend along arcs of 90 degrees, and the shafts 18 are mounted in the holder 11'. One arm of each bell crank lever 21 carries a shaft 22 for the respective upper knife 13', and the other arms of all levers 21 are coupled to a common connecting rod 23 extending in the direction of arrow 2. The front end portion of the rod 23 is articulately connected with an additional bell crank lever 21' which is pivotably mounted in the holder 11' and the lower arm of which is articulately connected with a motion transmitting rod 24 connected to one arm of a bell crank lever 27 pivoted in the frame F at 26 and carrying on its other arm a roller follower 28 which tracks the face of a stepwise driven disc cam 31 mounted on a shaft 29.

Figure 3:
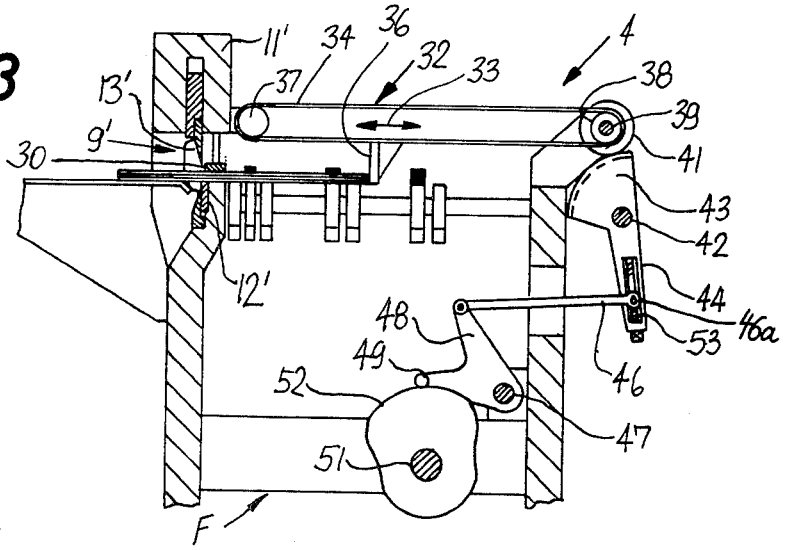
FIG. 3 is a transverse sectional view of the mechanism at one of the three severing stations, substantially as seen in the direction of arrows from the line III—III of FIG. 1.

FIGS. 2 and 3 further show hold-down devices 30 which are adjacent to the mobile knives 13 and 13' and serve to hold the sheets 1, 1A and 1B against movement relative to the frame F while the respective knives 13 and 13' perform their working strokes to trim successively introduced sheets 1' or to subdivide the respective sheets 1, 1A and 1B so as to separate individual leaves 8 therefrom.

The severing stations 4, 6 and 7 further accommodate transporting units 32 which, as shown in FIG. 3, extend transversely of the direction of transport of sheets 1, 1A, 1B (arrow 2) and serve to shift the sheets at the respective severing stations sideways prior to each severing operation. Each transporting unit 32 comprises a flexible element in the form of an endless belt conveyor 34 which is movable back and forth in directions indicated by a double-headed arrow 33 and is provided with an entraining element in the form of an outwardly extending pusher 36. The pushers 36 of successive conveyors 34 (as considered in the direction of arrow 2) are staggered with reference to each other by the width of a leaf 8. Each conveyor 34 is trained about an idler pulley 37 and a driver pulley 38. The pulleys 38 of all three conveyors 34 are mounted on a common shaft 39 one end portion of which carries a gear 41 in mesh with a second gear here shown as a gear segment 43 constituting or mounted on the upper arm of a two-armed lever 44 which is pivotable about the axis of a horizontal shaft 42 and the lower arm of which is articulately and adjustably connected with one end portion of a coupling link 46. The other end portion of the link 46 is articulately connected with one arm of a bell crank lever 48 which is mounted for angular movement about the axis of a shaft 47 and the other arm of which carries a roller follower 49 tracking the peripheral surface of a disc cam 52 mounted on a camshaft 51. The shafts 39, 42, 47 and 51 are mounted in the frame F. The cam 52 is driven by a stepping motor, not specifically shown.

The right-hand end portion of the coupling link 46, as viewed in FIG. 3, carries a pin 46*a* which is connected with a nut (not specifically shown) in mesh with a feed screw 53 which is rotatably mounted in the lower arm of the lever 44. By rotating the feed screw 53, an operator can shift the right-hand end portion of the coupling link 46 nearer to or further away from the axis of the shaft 42 to thereby change the extent of angular displacement of the shaft 39 (and hence the extent of linear displacement of the corresponding pusher 36) in response to rotation of the cam 52. In other words, the feed screw 53 can change the effective length of the lever 44 and conform the extent of movement of the respective pusher 36 to the desired width of leaves 8.

The means for advancing the sheets 1, 1A and 1B in the direction of arrow 2 comprises a set of endless belt or band conveyors 54 which are disposed in parallel vertical planes and carry entraining elements in the form of pushers 57. Each of the sheets on the upper reaches of the conveyors 54 is confined between a front pusher and a rear pusher 57. The sheets 1A are confined between a smaller number of pushers 57 because their width is less than that of the sheets 1, and the sheets 1B are confined between an even smaller number of pushers 57. Alternatively, and as shown in FIG. 1, the number of pushers 57 which engage a sheet 1 is the same as that of the pushers 57 which engage a sheet 1A. Also, the conveyors 54 may be arranged in groups of two or more whereby the pusher 57 of one conveyor 54 in a group engages the trailing edge of a sheet while the pusher 57 on the other conveyor 54 of the same group engages the front edge of the same sheet. FIG. 1 shows a leftmost group of three conveyors 54, a median group of two conveyors 54, and a right-hand group of two conveyors 54. The manner in which the conveyors 54 can be driven to move their pushers 57 into and from engagement with the respective edges of sheets is disclosed, for example, in my commonly owned copending patent application Ser. No. 417,662 filed Sept. 13, 1982 or in the commonly owned copending application Ser. No. 420,855 filed Sept. 21, 1982 by Bernd Ramcke and Günther Stahl.

FIG. 4 shows schematically a stepping motor 56 which is used to operate the advancing means for the sheets 1', 1, 1A, and 1B, i.e., to operate the conveyors 54 at intervals in order to advance successive sheets from the preceding to the respective next-following stations.

The operation is as follows:

In the positions of the various parts as shown in FIG. 1, each of the stations 4, 6 and 7 accommodates a sheet 1 or a portion of a sheet 1. An untrimmed sheet 1' is supported by the conveyors 54 upstream of the first severing (trimming) station 3, a trimmed sheet 1 is located at the station 3, a sheet 1A is located at the station 4, a sheet 1B is located at the station 6, and a portion (half) of a sheet 1B (namely, a leaf 8) is located at the station 7. While the conveyors 54 are idle between two successive movements, each of the mobile upper knives 13, 13' performs a downward stroke and thereby cooperates with the corresponding stationary knife 12, 12' to trim the lateral marginal portions of a sheet 1' at the station 3 or to separate a leaf 8 from a sheet 1, 1A or 1B at the station 4, 6 or 7. Such downward movements of the knives 13 and 13' are effected in response to rotation of the cam 31 which can also drive the knives 13 of the mechanism at the severing station 3, e.g., through the medium of a gear train receiving motion from the shaft 29 or 26. Alternatively, the knives 13 of the severing mechanism at the station 3 can receive motion from a further cam (not shown) deriving motion from or being driven in synchronism with the cam 31 of FIG. 4. Still further, the knives 13 of FIG. 3 can receive motion from a leftward extension 23*a* of the shaft 23 shown in FIG. 4. The arcuate grooves 19 in the holder 11' of FIG. 4 ensure that the knives 13' of the mechanisms at the severing stations 4, 6 and 7 move downwardly along paths extending along arcs of 90 degrees and thereby cooperate with the associated fixed knives 12' in order to sever the respective sheets 1, 1A and 1B. The severing action of mobile knives 13 at the trimming station 3 is preferably similar or analogous. When the knives 13 and 13' complete their downward strokes, the sheet 1' at the station 3 is converted into a trimmed sheet 1, the sheet 1 at the station 4 is converted into a sheet 1A and a leaf 8, the sheet 1A at the station 6 is converted into a sheet 1B and a leaf 8, and the sheet 1B at the station 7 is converted into two halves or leaves 8. The left-hand leaves 8 (as viewed in FIG. 1), which are separated from the sheets 1, 1A and 1B at the stations 4, 6 and 7, are taken over by a take-off conveyor 58 which advances them in the direction of arrow 2 toward the next processing station, e.g., a stacking station where the leaves 8 are assembled into stacks of requisite height or (if each of the leaves 8 already constitute a stack of two or more superimposed leaves) to a station where the leaves are perforated for reception of suitable binders, e.g., spiral binders, Wire-O (trademark) binders or the like. Furthermore, the leaves 8 can be transported to a station where their rear or top edges are coated with adhesive to convert the leaves into pads wherein the neighboring sheets are held together by an adhesive medium.

The knives 13 and 13' are returned to their upper end positions upon completion of each severing step. The transporting units 32 are set in motion by the cam 52 to move the leaves 8 to be separated into the range of the take-off conveyor 58. To this end, each conveyor 34 of each transporting unit 32 is moved through a distance corresponding to the width of a leaf 8, always in a direction transversely of that indicated by the arrow 2 and toward the take-off conveyor 58. FIG. 1 shows the transporting units 32 in positions they assume after the corresponding pushers 36 have completed their forward (leftward) strokes, i.e., upon completed transfer of a series of leaves 8 from the stations 4, 6 and 7 onto the take-off conveyor 58. The pushers 36 are held in their retracted positions while the conveyors 54 of the sheet advancing means are in motion, and the cam 52 thereupon causes each of the conveyors 34 to perform a forward and return movement and to thus transfer a leaf 8 from the respective station 4, 6 or 7 onto the take-off conveyor 58 prior to retraction of the respective pusher 36 back to its starting or initial position. A suitable spring (not specifically shown) is provided to maintain the roller follower 49 of the bell crank lever 48 in permanent contact with the face of the disc cam 52.

FIG. 1 shows that the apparatus preferably comprises an additional transporting unit 32' which is disposed downstream of the severing station 7, as considered in the direction of arrow 2, and serves to transfer the right-hand halves of successive sheets 1B from the conveyors 54 onto the take-off conveyor 58. Such right-hand halves or leaves of successive sheets 1B are transported beyond the station 7 by the three leftmost conveyors 54 of the sheet advancing means.

If the operators wish to convert the apparatus for the subdivision of sheets into leaves whose width deviates from that of the illustrated leaves, the operators merely adjust the coupling member 46 with reference to the lever 44, and (if necessary) the operators also change the distance between the knife holders 11 and 14 of FIG. 2. This completes the work which is involved in changing the setup, i.e., in preparing the apparatus for the conversion of sheets into leaves of greater or lesser width.

If the knives 12, 13, 12' or 13' require inspection and/or replacement, such knives are readily accessible at the left-hand side of the frame F, as viewed in FIG. 1, i.e., at the outer side of the respective station.

An important advantage of the improved apparatus is that the sheets 1, 1A and 1B at the severing stations 4, 6 and 7 can readily yield during penetration of the respective knives 13', i.e., the freshly formed leaves 8 can move in a direction to the left, as viewed in FIG. 1, to account for the thicknesses of the knives 13' and to thus ensure the making of clean and highly predictable cuts. This is due to the fact that only one leaf 8 is separated at each of the severing stations 4, 6 and 7. Consequently, the improved apparatus can be used with considerable advantage for the severing of individual sheets of any desired thickness as well as for the severing of stacked sheets.

The situation is analogous at the trimming station 3, i.e., the surplus which is removed by the right-hand and by the left-hand mobile knives 13 can yield during its separation so that the remainder (1) of each untrimmed sheet 1' need not buckle or undergo other types of deformation in the course of the trimming operation.

Another important advantage of the improved apparatus is that the conversion of the apparatus for the making of leaves having different widths takes up very little time. All that is necessary is to effect appropriate adjustments of the initial angular positions of the coupling member 46 and of the distance between the holders 11 and 14 of FIG. 2.

Finally, each of the knives is readily accessible for inspection and/or replacement, i.e., such knives are accessible without necessitating any or by necessitating minimal dismantling of the apparatus.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for subdividing sheets of multiple unit width, particularly for subdividing paper sheets of multiple unit width into leaves of unit width, comprising advancing means operable to move a succession of sheets stepwise in a predetermined direction along a predetermined path at a right angle to the width of the sheets; a plurality of severing stations disposed in successive portions of said path, as considered in said direction; severing units provided at said stations and each including means for separating a leaf from the sheet at the respective station during the interval of dwell of said advancing means between successive operations thereof to move the sheets from the preceding to the next-following stations; and means for transporting the sheets at said stations at a right angle to said direction prior to separation of leaves from such sheets, and prior to next-following operation of said advancing means, through increments corresponding to said unit width.

2. The apparatus of claim 1, wherein said separating means comprise knives which are aligned with one another, as considered in said direction.

3. The apparatus of claim 2, wherein said stations have inner and outer sides and said knives are located and accessible at the outer sides of the respective stations.

4. The apparatus of claim 1, wherein each of said separating means comprises a stationary knife at one side of said path and a mobile knife at the other side of said path.

5. The apparatus of claim 4, wherein said path is at least substantially horizontal and said mobile knives are located at a level above such path.

6. The apparatus of claim 4, further comprising common drive means for said mobile knives.

7. The apparatus of claim 1, wherein each of said transporting means comprises a flexible element and an entraining element provided on the flexible element and movable into and from engagement with sheets at the respective station.

8. The apparatus of claim 7, wherein said flexible elements are endless belts and said entraining elements are pushers provided on and extending outwardly from the respective belts.

9. The apparatus of claim 7, further comprising common drive means for said flexible elements.

10. The apparatus of claim 9, wherein said drive means comprises a shaft extending in said direction, means for transmitting motion from said shaft to said flexible elements, and means for rocking said shaft back and forth including a first gear on said shaft, a second gear meshing with said first gear, and cam-and-follower means for rotating said second gear back and forth.

11. The apparatus of claim 10, wherein said rocking means further comprises a lever having a first arm and a second arm, pivot means for said lever, a gear segment constituting said second gear and provided on one of said arms, and a coupling member articulately connected with said cam-and-follower means and with the other arm of said lever.

12. The apparatus of claim 11, further comprising means for changing the distance between said pivot means and the locus of connection of said coupling member with said other arm.

13. The apparatus of claim 12, wherein said distance changing means comprises a rotary feed screw mounted on said lever.

14. The apparatus of claim 1, further comprising a trimming station located in a further portion of said path ahead of the foremost severing station, as considered in said direction, and means for trimming two lateral marginal portions of successive sheets at said trimming station.

15. The apparatus of claim 14, wherein said trimming means comprises first and second knife holders flanking said further portion of said path and means for shifting one of said holders toward and away from the other of said holders.

16. The apparatus of claim 15, wherein said shifting means comprises a rotary feed screw.

17. The apparatus of claim 1, further comprising take-off conveyor means adjacent to one side of said path and arranged to remove from said stations freshly separated leaves by moving such leaves in said direction.

18. The apparatus of claim 1, wherein said advancing means comprises a plurality of endless conveyors disposed in parallel vertical planes and having entraining means for advancing the sheets in said direction.

19. The apparatus of claim 1, wherein said advancing means comprises means for advancing one-half of the sheet at the last of said stations, as considered in said direction, into a further portion of said path, and further comprising additional transporting means for removing such half sheet from said further portion of said path by moving the half sheet at right angles to said direction.

* * * * *